US005535896A

United States Patent [19]

Morgan, Sr.

[11] Patent Number: 5,535,896

[45] Date of Patent: Jul. 16, 1996

[54] HANGING APPARATUS FOR MULTIPLE TROUSERS

[76] Inventor: Donald E. Morgan, Sr., 34850 SW. 189 Ave., Homestead, Fla. 33034

[21] Appl. No.: 494,085

[22] Filed: Jun. 23, 1995

[51] Int. Cl.[6] ..... A47F 5/00

[52] U.S. Cl. ..... 211/96; 211/168

[58] Field of Search ..... 211/96, 99, 100, 211/168, 171, 95

[56] References Cited

U.S. PATENT DOCUMENTS

| | | | |
|---|---|---|---|
| 1,796,344 | 3/1931 | Pleiss | 211/96 |
| 2,455,213 | 11/1948 | Bell | 211/96 X |
| 2,595,521 | 5/1952 | Hanson | 211/96 X |
| 2,610,742 | 9/1952 | Stanton | 211/96 X |
| 3,352,430 | 11/1967 | McAtee | 211/119 |
| 4,323,164 | 4/1982 | Steinhilber | 211/100 |
| 4,360,109 | 11/1982 | Kurtz | 211/100 |
| 4,594,754 | 6/1986 | Spicer | 24/536 |
| 4,723,665 | 2/1988 | Benedict et al. | 211/96 X |
| 4,836,624 | 6/1989 | Schwickrath | 312/216 |

FOREIGN PATENT DOCUMENTS

| | | | |
|---|---|---|---|
| 1539384 | 1/1979 | United Kingdom | 211/96 |

*Primary Examiner*—Robert W. Gibson, Jr.
*Attorney, Agent, or Firm*—Alvin S. Blum

[57] ABSTRACT

Apparatus provides multiple pivotal rods or dowels for hanging many garments such as trousers or skirts in a confined space. An elongate base is mounted on a vertical wall with its long axis vertical. An elongate rigid bar having a circular cross section is mounted at both ends to the base, with the bar vertical and spaced away from the base. The bar supports multiple horizontal parallel rods pivotally mounted, one atop the other, by a transverse hole through one end of each rod. A spacer is interposed between adjacent rods to allow sufficient space for a garment folded over the rod. Any garment may be accessed by simply swinging all of the garments above it to one side and all of the garments below it to another side of the bar, leaving the garment free on its rod.

8 Claims, 1 Drawing Sheet

HANGING APPARATUS FOR MULTIPLE TROUSERS

BACKGROUND OF THE INVENTION

This invention relates to clothing holders and more particularly to a device to hang a plurality of trousers in a limited space.

Conventional haters for trousers, skirts and the like ordinarily hold a sidle garment in a non-wrinkling condition with a top hook for hooking over a closet rod. When the number of garments that need to be stored exceeds the space or hangers available, it is common practice to try to hang more than one garment on a hanger. This is awkward and frequently results in wrinkling or dropping one or more of the garments. Prior art solutions to the problem have been awkward to use and expensive to produce.

U.S. Pat. No. 3,352,430 issued Nov. 14, 1967 to Atee discloses a swinging arm clothes rack in which a plurality of wire arms carrying spring clips are hung from a single hook. Latches hold the arms in place. When a garment is to be removed, those above it must be unlatched and swung out to gain access thereto.

U.S. Pat. No. 4,323,162 issued Apr. 6, 1982 to Steinhilber discloses a multiple-trouser-hanger in which the trousers hang on rods. All of the rods are attached to a long bar mounted on a wall by a complex pivot mechanism. The rods all are fixed in a common plane. That plane is vertical for storage. The plane is pivoted on the pivot mechanism until it is horizontal in order to separate the garments enough to extricate any one of them, requiring the raising and lowering of the entire rack full of garments.

SUMMARY OF THE INVENTION

It is accordingly an object of the invention to provide apparatus for hanging a plurality of trousers and the like in a limited space. It is another object that access to any selected one of the plurality be readily made without lifting any of the others and without any significant effort.

The apparatus of the invention includes an elongate base that is to be affixed to a vertical support or wall, with the long axis of the base vertical. A long vertical rod with a circular cross section is attached at its top and bottom to the base, spaced apart from, and parallel to, the base. A plurality of horizontal dowels are arranged parallel to one another and at right angles to the bar. Each dowel is pivotally attached at one end to the bar. The dowels are arranged one atop the ether and spaced apart from one another by spacers on the rod so that there is enough space between dowels to accomodate a pair of trousers folded over each dowel when the dowels are all swung into a common plane. By loading the trousers in a consistent pattern on the dowels, as described below, the user may access any single item by simply swinging all those above or below to one side. The garment may then be removed without disturbing any of the others.

These and other objects, advantages and features of the invention will become more apparent when the detailed description is studied in conjunction with the drawings.

DETAILED DESCRIPTION OF THE PREFERRED EMBODIMENTS

Figure 1:
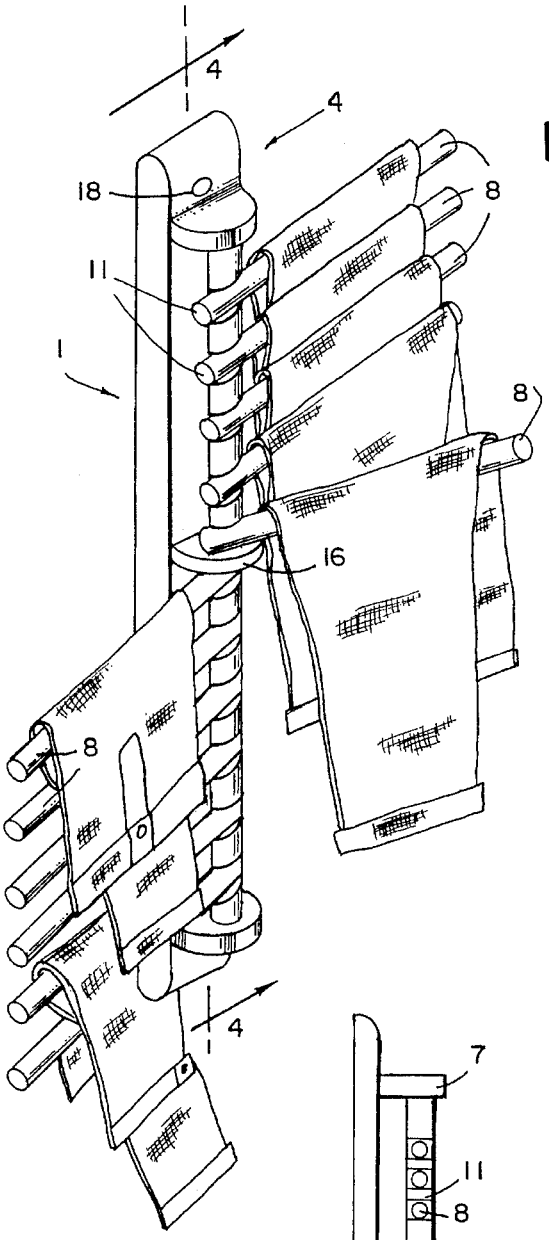
FIG. 1 is a perspective view of the apparatus with trousers in place.
Figure 2:
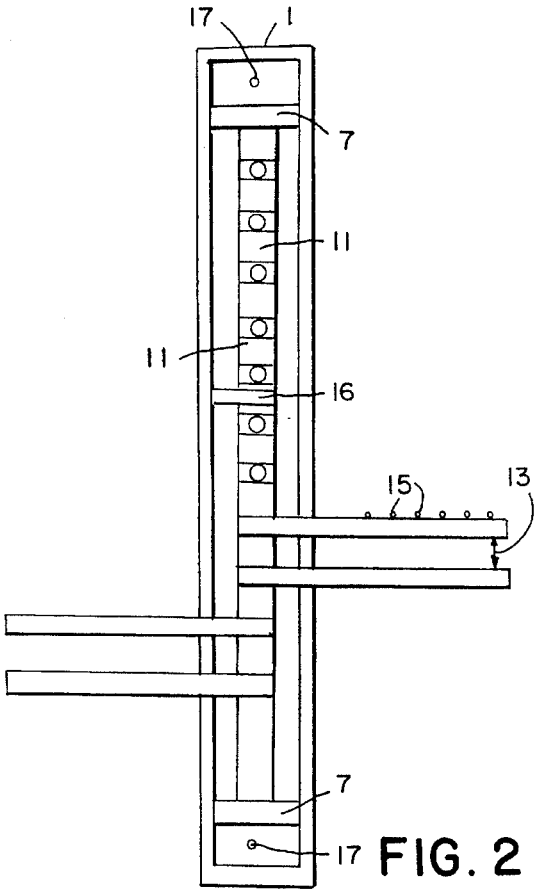
FIG. 2 is a front elevation view of the invention.
Figure 3:
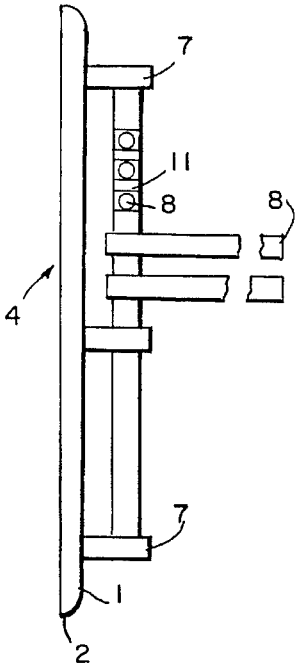
FIG. 3 is a side elevation view of the invention.
Figure 4:
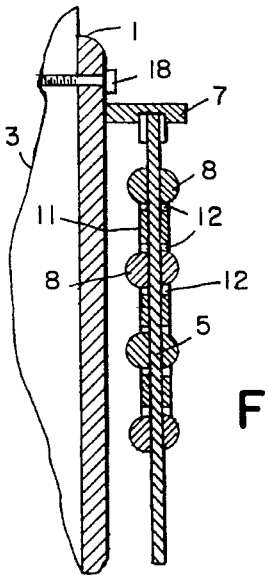
FIG. 4 is a sectional view taken on a portion of the line 4—4 of FIG. 1.

Referring now to FIGS. 1–4, the apparatus 4 of the invention includes an elongate base 1 having a long axis 2, with top and bottom holes 17 for mounting the apparatus on a vertical support or wall 3 by fasteners 18. A rigid steel bar 5 is fixed in two end supports 7 so that it is parallel to the long axis 2 of the base and spaced away from the base. An optional center support 16 may be provided to enhance rigidity when a very long bar is used.

A plurality of long rods or dowels 8 are pivotally mounted on bar 5 so that they are orthogonal to the bar, horizontal, and one atop another. Spacers 11, separately mounted between rods 8, space the rods 8 apart from one another by a distance great enough to permit receiving therebetween the garment folded over the lowermost of two adjacent rods. As shown in the figures, the length of each spacer is greater than the rod diameter. A lubricous washer 12 may be interposed between rod 8 and spacer 11 to reduce friction when pivoting the rods 8. This is preferably of nylon. The rods 8 may be smooth surfaced wood dowels 1.59 cm diameter, 38 cm long with a transverse hole 0.8 cm diameter drilled 1.3 cm from the end to allow it to pivot on the 1.3 cm bar. The spacers 11 are also separate dowels with axial holes drilled to fit on the bar between rods. The space 13 between adjacent rods is great enough to admit therebetween a garment such as trousers or a skirt folded over the lower rod. The rods may be provided with a non-slip surface 15 such as that applied to the underside of a rug. This will prevent a garment from sliding off the rod if the garment is not positioned with equal weight on the two sides of the rod.

The mode of operation is best seen in FIG. 1. When the apparatus 1 is fully loaded with garments, access to any one garment is achieved by simply pivoting all the upper rods in a first direction and all of the lower rods in a second direction. This leaves the desired garment free of the other garments so that it may be simply lifted off the rod. There is no need to lift the other garments, and there is no latching and unlatching as in the prior art.

The spacer may alternatively be made of an inherently lubricous material such as polyolefin or nylon to eliminate the washers.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made Within the underlying idea or principles of the invention within the scope of the appended claims.

What is claimed is:

1. An apparatus for hanging multiple trousers in a limited space, the apparatus comprising:

an elongate base having a long axis, said base arranged to be affixed to a vertical supporting surface with said long axis vertical;

an elongate rigid bar having two ends and a substantially circular cross section, said bar attached at both said ends to said base such that said bar is spaced apart from said base and parallel to said long axis;

a plurality of rods, each rod having a diameter, and being long enough to support trousers hung thereon, each rod having a free first end and a second end, each second end pivotally mounted orthogonally to said bar such that the plurality of rods are horizontal, parallel to one another, and one above the other when said base is vertically mounted;

a plurality of separate spacers mounted on said bar separately with only one of the spacers mounted between adjacent rods, the spacers spacing the rods apart from one another by sufficient distance to admit a pair of trousers hung on a lower one of the rods to the space between the lower one of the rods and an immediately adjacent upper rod, said distance being greater than said diameter; and a low friction washer interposed between each rod and spacer.

2. An apparatus for hanging multiple garments in a limited space, the apparatus comprising:

an elongate base having a long axis, said base arranged to be affixed to a vertical supporting surface with said long axis vertical;

an elongate rigid bar having two ends and a substantially circular cross section, said bar attached at both said ends to said base such that said bar is spaced apart from said base and parallel to said long axis;

a plurality of rods, each rod having a diameter, and being long enough to support garments hung thereon, each rod having a free first end and a second end, each second end pivotally mounted orthogonally to said bar such that the plurality of rods are horizontal, parallel to one another, and one above the other when said base is vertically mounted;

a plurality of separate spacers mounted on said bar separately with only one of the spacers mounted between adjacent rods, the spacers spacing the rods apart from one another by sufficient distance to admit a garment hung on a lower one of the rods to the space between the lower one of the rods and an immediately adjacent upper rod, said distance being greater than said diameter; and a low friction washer interposed between each rod and spacer.

3. The apparatus according to claim 1, in which each rod is provided with a non-slip surface.

4. The apparatus according to claim 1, in which each rod is provided with a transverse cylindrical passage through said second end, said bar passing through said passage to provide pivotal mounting of the rod on said bar.

5. The apparatus according to claim 1, in which said washer is at least partially made of nylon.

6. The apparatus according to claim 2, in which each rod is provided with a non-slip surface.

7. The apparatus according to claim 2, in which each rod is provided with a transverse cylindrical passage through said second end, said bar passing through said passage to provide pivotal mounting of the rod on said bar.

8. The apparatus according to claim 2, in which said washer is at least partially made of nylon.

* * * * *